United States Patent [19]

James et al.

[11] Patent Number: 4,529,988

[45] Date of Patent: Jul. 16, 1985

[54] TRAVELLING WAVE ANTENNA WITH SIDE LOBE ELIMINATION

[75] Inventors: James R. James; Peter S. Hall, both of Swindon, England

[73] Assignee: The Secretary of State for Defence in Her Britannic Majesty's Government of the United Kingdom of Great Britain and Northern Ireland, London, England

[21] Appl. No.: 464,135

[22] Filed: Feb. 7, 1983

[30] Foreign Application Priority Data

Feb. 8, 1982 [GB] United Kingdom ..... 8203580

[51] Int. Cl.[3] ..... H01Q 11/04

[52] U.S. Cl. ..... 343/731; 343/379

[58] Field of Search ..... 343/734, 771, 700 MS File, 343/731, 379

[56] References Cited

U.S. PATENT DOCUMENTS

| | | | |
|---|---|---|---|
| 1,768,239 | 6/1930 | Englund | 343/728 |
| 2,237,765 | 4/1941 | Moser | 343/734 |
| 4,196,436 | 4/1980 | Westerman | 343/770 |

FOREIGN PATENT DOCUMENTS

| | | |
|---|---|---|
| 710453 | 9/1941 | Fed. Rep. of Germany . |
| 738032 | 7/1943 | Fed. Rep. of Germany . |
| 1093433 | 6/1961 | Fed. Rep. of Germany . |
| 1111251 | 2/1962 | Fed. Rep. of Germany . |
| 1503664 | 3/1978 | United Kingdom . |

*Primary Examiner*—Eli Lieberman

*Attorney, Agent, or Firm*—Cushman, Darby & Cushman

[57] ABSTRACT

The arrangement is for cancelling unwanted sidelobes in travelling-wave arrays, especially the back lobe where the main beam approaches the end-fire direction; the array should have high symmetry, i.e., with the usual form of array (radiators spaced along a single feeder), the radiation patterns when fed from either end should be mirror images. Cancellation is obtained by having feed connections (2,2') at both ends of this form of array (1), the feed at one end being attenuated (8) relative to the other and effectively subtracted (6) therefrom. In RF form, for receiving or transmitting, the subtraction can be effected by phase-reversing (7) the signal in one of the feed connections. In baseband form, suitable for receiving only, diodes are included in both feed connections and subtraction performed at baseband frequency.

8 Claims, 7 Drawing Figures

Fig. 1.
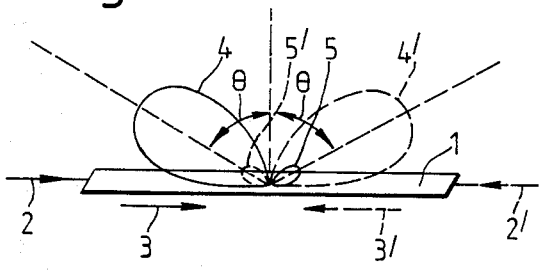
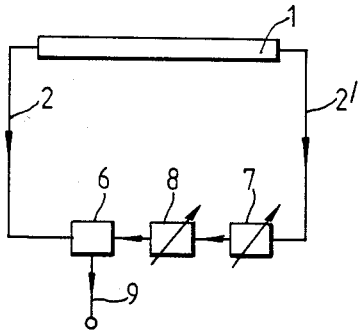
Fig. 2.
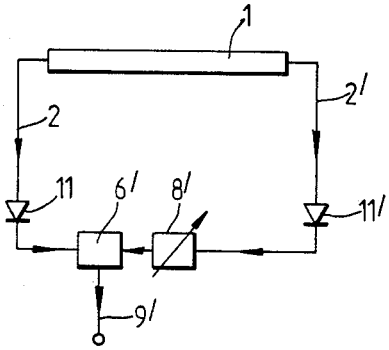
Fig. 4.
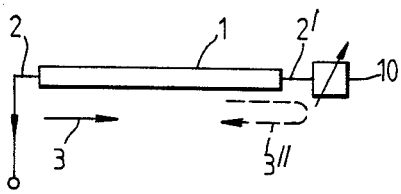
Fig. 3.

TRAVELLING WAVE ANTENNA WITH SIDE LOBE ELIMINATION

This invention relates to antenna array circuits, in particular for travelling-wave arrays, and is concerned with the elimination or reduction of unwanted sidelobes in the radiation patterns of such arrays.

Where the radiation pattern of a first antenna has a sidelobe which is required to be reduced, it is known practice to provide, adjacent the first antenna, a second antenna having a main beam in the direction of the sidelobe of the first antenna, the second antenna being fed in antiphase with the first with sufficient power to cancel the sidelobe in the combined pattern. The present invention enables a smimilar affect to be obtained using only a single antenna array and is therefore more economical in this respect.

The present invention is applicable only to travelling-wave arrays operating with main beams pointing off normal to the array, and can produce complete or partial cancellation of a sidelobe symmetrically placed about the normal from the main beam. This is particularly useful when operating with the main beam close to 90° off the normal (ie approaching end-fire) and suppression of a symmetrically occurring back lobe is required. Desirably the array itself should have a high degree of symmetry, in the sense that the radiation patterns when the array is fed from two alternative terminals thereof (usually but not essentially at respective ends of the array, as hereinafter explained) are mirror-images of one another. To the extent that the array lacks such symmetry, the beneficial effect of the present invention may be reduced. (Usually a symmetrical array will be physically symmetrical about the mid-point of the array, in the sense that its configuration relative to an observer will be unchanged if it is rotated through 180° in the plane of the array about an axis through the mid-point and perpendicular to that plane).

The invention has one application in microstrip antennas, but is not limited thereto and can be applied to any form of travelling-wave array, eg waveguide slots, dipole arrays or triplate slots.

According to the present invention, an antenna array circuit comprises:

a travelling wave antenna array having a substantial degree of symmetry (as hereinbefore defined), whose radiation pattern when fed from one terminal of the array includes a wanted main beam and an unwanted sidelobe, which sidelobe is at least partially overlapped by the main beam of the mirror image of said pattern when the array is fed from a second terminal of the array;

a first feed connection to said one terminal of the array and a second feed connection to said second terminal of the array; and means whereby, when a signal is received or transmitted by the array, the signals thereby simultaneously present in the first and second feed connections coact so that, in effect, the main beam in the mirror-image pattern, in attenuated form, is subtracted from the unwanted sidelobe thereby to reduce or eliminate said sidelobe. The first and second terminals may be at respective ends of the array.

The coaction of the two signals may be performed either at the radio-frequency of the array, or at baseband (eg video) frequency. In radio frequency form, the invention can provide either a receiving or a transmitting array circuit. In receiving form the second feed connection may include an attenuator, means being provided for subtracting the attenuated signal in the second feed connection from the signal in the first feed connection to provide a receiver signal in which the unwanted sidelobe is reduced or eliminated; one feed connection (preferably said second) may include phase-reversal means, the aforesaid subtraction being obtained by adding the phase-reversed signal in said one feed connection to the signal in the other connection. In the corresponding transmitting form, means may be provided to couple-off an appropriate minor proportion of the signal from the transmitter into the second feed connection and to effect phase-reversal thereof, the remainder of the transmitter signal being fed to the first feed connection. In another radio-frequency form, suitable for either receiving or transmitting, the second feed connection comprises mismatch means for reflecting the travelling wave from the array back into the array with the appropriate phase and amplitude to reduce or eliminate the unwanted sidelobe.

In baseband form, the invention provides only a receiving array circuit. In such form the first and second feed connections may both include unidirectional conducting means for deriving the baseband frequency from the radio-frequency signals in the array, the second feed connection also including attenuator means and means being provided for subtracting the thus-attenuated baseband signa in the second feed connection from the baseband signal in the first feed connection to provide the receiver signal.

To enable the nature of the present invention to be more readily understood, attention is directed, by way of example, to the accompanying drawings wherein:

FIG. 1 is a simplified diagram showing typical mirror-image radiation patterns, including side-lobes, for a symmetrical travelling-wave array;

FIGS. 2 and 3 are circuit diagrams of alternative radio-frequency forms of the present invention.

FIG. 4 is a circuit diagram of a baseband form of the invention.

Figure 5:
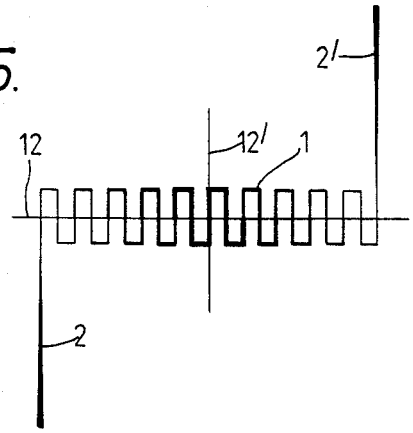
FIG. 5 is a plan view of a symmetrical microstrip array used in one embodiment of the invention.

In FIG. 1 a symmetrical travelling-wave array is shown symbolically as a rectangle 1. With a feed connection 2 to its left-hand end (and a matched termination (not shown) at its right-hand end), the travelling wave travels in the direction of arrow 3 and the radiation pattern comprises a main beam 4 and a sidelobe 5. Correspondingly, with the feed connection 2' to its right-hand end, the radiation patterns are seen to be mirror-images of each other, either side of a transverse plane normal to the plane of the array, and in the example each sidelobe is symmetrically placed about the normal from its respective main beam.

It is assumed in the present description that the wanted main beam is beam 4, and that it is desired to eliminate, or at least substantially reduce, the unwanted sidelobe 5. (If 4' were the wanted main beam and 5' the unwanted sidelobe, the array connections to be described would be reversed.)

In FIG. 2, the connection 2 is taken direct to a radio-frequency adder 6. The connection 2' is taken to adder 6 via a variable phase-shifter 7 and a variable attenuator 8. The two latter components are adjusted so that the amplitude of the main beam 4′ matches that of sidelobe 5 and the phase of main beam 4′ is opposite to that of sidelobe 5, as nearly as possible, ie phase-shifter 7 is adusted to effect phase reversal. In this way the attenuated main beam 4′ is effectively subtracted from the sidelobe 5 at adder 6, to reduce or eliminate it. A receiver is connected to connection 9. The impedances of connections 2 and 2′ must match the array impedance to prevent reflections. (In principle the phase-shifter 7 and the attenuator 8 can each be connected in a different feed connection 2,2′, but it is preferred to connect them in the same connection as shown, in order to maximise the net receiver signal.) In transmitting form phase-shifter 7 is retained but attenuator 8 is omitted, and adder 6 is replaced by a coupler which couples-off the appropriate fraction of the transmitter output (connected to connection 9) to match the amplitude of the unwanted sidelobe.

In FIG. 3 no adder or coupler is required and the transmitter or receiver is connected directly to connection 2. The connection 2′ is taken to a mismatch unit 10 which reflects the travelling wave back into the array (see arrow 3″) with the appropriate amplitude and with phase-reversal so that the attenuated beam 4′ is effectively subtracted in the array itself and eliminates or reduces sidelobe 5′.

In FIG. 4 diodes 11 and 12 are introduced into connections 2 and 2′ respectively and the phase-shifter is eliminated. An attenuator 8′ is retained in connection 2′. The two signals are subtracted as previously, but at baseband frequency, in a baseband subtractor 6′. Clearly this form of the invention can be used for receiving only.

FIG. 5 shows, to scale, a symmetrical, tapered-aperture, microstrip array. Its symmetry can be seen by notionally rotating it about the intersection of its longitudinal and transverse axes, 11 and 12 respectively, when its configuration remains unchanged. The array is designed for operation at about 17 GHz, the lengths of the transverse sections being 0.75 λg and of the longitudinal sections 0.25 λg where λg is the wavelength in the strip at 17 GHz. This array gave a main beam at $\theta=+60°$ of beamwidth 40° ($\theta=0°$ is the broadside direction, ie normal to the plane of the array).

Using the array of FIG. 5 in the arrangement of FIG. 2, ie radio-frequency operation, the unwanted sidelobe was reduced by >4 dB over the region $-90°<\theta<-55°$. This result was obtained over a very narrow bandwidth only.

Figure 6:
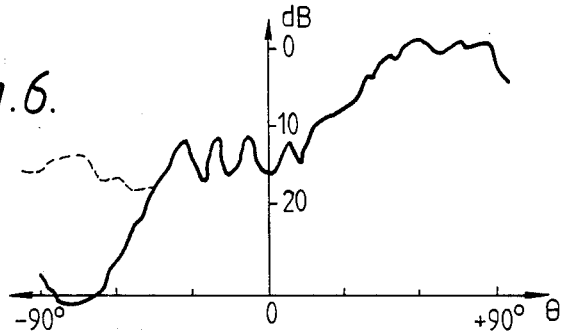
FIG. 6 is a graph of results obtained using the array of FIG. 5.

Using the array of FIG. 5 in the arrangement of FIG. 4, ie baseband operation, the unwanted side was reduced by >10 dB over the region $-90°<\theta<-60°$ and over a 0.5 GHz bandwidth, ie a bandwidth much greater than that obtained with the FIG. 2 arrangement. This result is shown graphically in FIG. 6 where the interrupted line shows the sidelobe level with connection 2′ replaced by a simple matched termination.

It will be seen that although in these examples a valuable degree of sidelobe reduction is obtained, perfect cancellation is not achieved. In practice the degree of cancellation may be degraded by the following factors:

(a) Lack of symmetry in the array (b) Unequal mismatches in the feed connections (c) Poor phase-tracking, in the case of radio-frequency operation (FIGS. 2 and 3), between the main beam and the sidelobe (ie the phase variation across the sidelobe, so that at some points the respective radiations cancel and at others add)

(d) Cross-polarisation

Figure 7:
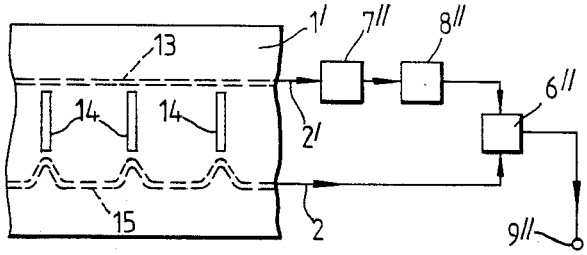
FIG. 7 is a circuit diagram of a further radio-frequency form of the invention.

In FIGS. 1–5 the two feed connections are taken from terminals at physically opposite ends of the array, but this is not essential provided an electrically equivalent result is obtained. For example, in British Patent Specification No. 1,503,664 there is described with reference to FIG. 3 thereof an array of triplate slots having two stripline feeders, arranged as in the array 1′ of present FIG. 7. (Usually, of course, the radiators of a travelling-wave array are spaced along a single feeder.) Feeder 13 of array 1′ is straight, whereas feeder 15 has a sinuous configuration which effectively increases its length between slots 14 so as to effectively reduce the wavelength of the conveyed microwave energy. The connections to the respective feeder terminals are made at the same end of the row of slots 14. In this way, as more fully described in Specification No. 1,503,664, the direction of the radiation pattern can be made to depend on which of the two feeders is fed at the same end of the array 1′, as similarly, in the present FIGS. 1–5, it depends on which end of the usual single feeder is fed. FIG. 7 is a circuit diagram corresponding to FIG. 2 for an embodiment of the present invention using an array 1′ of this kind, both feed connections 2,2′ being made to the same end of the array (only part of which is shown). The array 1′ can similarly be used in embodiments corresponding to FIGS. 3 and 4.

It will also be appreciated that in the present invention it is the main beam of the mirror-image radiation pattern which produces whole or partial cancellation of the unwanted sidelobe. Thus the invention will only produce such cancellation of an unwanted sidelobe which coincides with the position of this main beam; unwanted sidelobes elsewhere in the pattern will not be affected. However, this limitation does not negate the value of the invention for many antenna applications.

We claim:

1. An antenna receiving array circuit comprising:

a travelling-wave antenna array having a substantial degree of symmetry, whose radiation pattern when fed from one terminal of the array includes a wanted main beam and an unwanted sidelobe, said sidelobe being at least partially overlapped by the main beam of the mirror image of said pattern when the array is fed from a second terminal of the array;

a first feed connection operatively connected to said one terminal of the array and a second feed connection operatively connected to said second terminal of the array, the first and second feed connections both including means for deriving baseband-frequency signals from radio-frequency signals received by the array;

means for attenuating and subtracting said baseband-frequency signals whereby the main beam in the mirror-image pattern, in attenuated form, is effectively subtracted from the unwanted sidelobe thereby to reduce the sidelobe.

2. An antenna array circuit as claimed in claim 1 wherein the first and second terminals are at respective ends of the array.

3. A circuit as in claim 1 wherein said means for deriving baseband-frequency signals comprises unidirectional conducting means.

4. An antenna array circuit as claimed in claim 3 wherein the first and second terminals are at respective ends of the array.

5. A directional antenna array adapted for connection to a receiver, said array comprising:

a travelling-wave antenna array having first and second feed points, said array having a reception pattern which has substantial degree of symmetry, a first reception pattern obtained when said receiver is connected to said first point including a major lobe and a minor lobe, said minor lobe at least partially overlapping the mirror image of the major lobe of a second reception pattern obtained when said receiver is connected to said second connection;

first means connected to said first point for deriving a first baseband signal from electromagnetic signals received by said array;

second means connected to said second point for deriving a second baseband signal from electromagnetic signals received by said array; and means for attenuating said first baseband signal and for subtracting said attenuated signal from said second baseband signal to attenuate said minor lobe in said second reception pattern.

6. An antenna array circuit as claimed in claim 5 wherein the first and second feedpoints are at respective ends of the array.

7. An antenna array as in claim 5 wherein said first and second baseband signal deriving means each include a unidirectional conducting means for restricting the flow of electrical signals to only one direction.

8. An antenna array as in claim 5 wherein said minor lobe is a sidelobe.

* * * * *